United States Patent [19]

Liou

[11] Patent Number: 5,040,445

[45] Date of Patent: Aug. 20, 1991

[54] GLAZED TILE CUTTER

[76] Inventor: Un-Fei Liou, No. 2, Jiann Guon Lane, Juinn Guon Li, Taichung, Taiwan

[21] Appl. No.: 517,031

[22] Filed: May 1, 1990

[51] Int. Cl.[5] ..... B28D 1/22

[52] U.S. Cl. ..... 83/886; 83/468; 83/588; 83/468.4; 125/23.02; 225/96.5

[58] Field of Search ..... 125/23.02, 23.01; 225/96.5; 83/886, 468, 468.4, 588

[56] References Cited

U.S. PATENT DOCUMENTS

| | | | |
|---|---|---|---|
| 1,511,016 | 10/1924 | Barker | 125/23.02 |
| 1,932,659 | 10/1933 | Granite | 125/23.01 |
| 1,994,420 | 3/1935 | Persson | 125/23.02 |
| 2,568,816 | 9/1951 | Marus | 125/23.02 |
| 2,680,458 | 6/1954 | Grammer | 83/468 |
| 2,884,965 | 5/1959 | Stahl | 83/468.3 |
| 4,679,476 | 7/1987 | Abreu | 83/886 |
| 4,922,886 | 5/1990 | Hepworth | 225/96.5 |

*Primary Examiner*—Hien H. Phan

*Attorney, Agent, or Firm*—Fleit, Jacobson, Cohn, Price, Holman & Stern

[57] ABSTRACT

A glazed tile cutter capable of straightly or circularly cutting a glazed tile is provided. The cutter includes an elongated base upon which are two longitudinally mounted brackets and mounted therebetween, two parallel sliding rods on which two sliding pieces are slidably mounted. Two cutters are respectively fixed onto the sliding piece for straightly and circularly cutting a glazed tile. A pad piece and a stopper are mounted on the base, with the stopper having a surface capable of abutting against one side edge of the glazed tile.

5 Claims, 5 Drawing Sheets

GLAZED TILE CUTTERBACKGROUND OF THE INVENTION

The present invention relates to a cutting tool, and more particularly to one for a glazed tile.

It is a popular practice to place glazed tile on the wall of a building. In order to completely tile the wall, a portion of a glazed tile is often required. Furthermore, a glazed tile having a circular hole is sometimes required. Up to now, there has not been a cutting tool capable of providing both straight and circular cutting functions.

SUMMARY OF THE INVENTION

It is therefore an object of the present invention to provide a glazed tile cutter capable of providing a straight cutting function, and a circular cutting function.

According to the present invention, a glazed tile cutter includes an elongate base upon which are two longitudinally mounted brackets and mounted therebetween, two parallel sliding rods on which two sliding pieces are slidably mounted. Two cutters are respectively fixed onto the sliding piece for straightly and circularly cutting a glazed tile. A pad piece, and a stopper mounted on the base, with the stopper having a surface capable of abutting against one side surface of the glazed tile. When cutting, the appropriate cutter is slid into position above the pad piece upon which the glazed tile to be cut rests.

The present invention may best be understood through the following description with reference to the accompanying drawings, in which:

DETAILED DESCRIPTION OF THE PREFERRED EMBODIMENT

Figure 1:
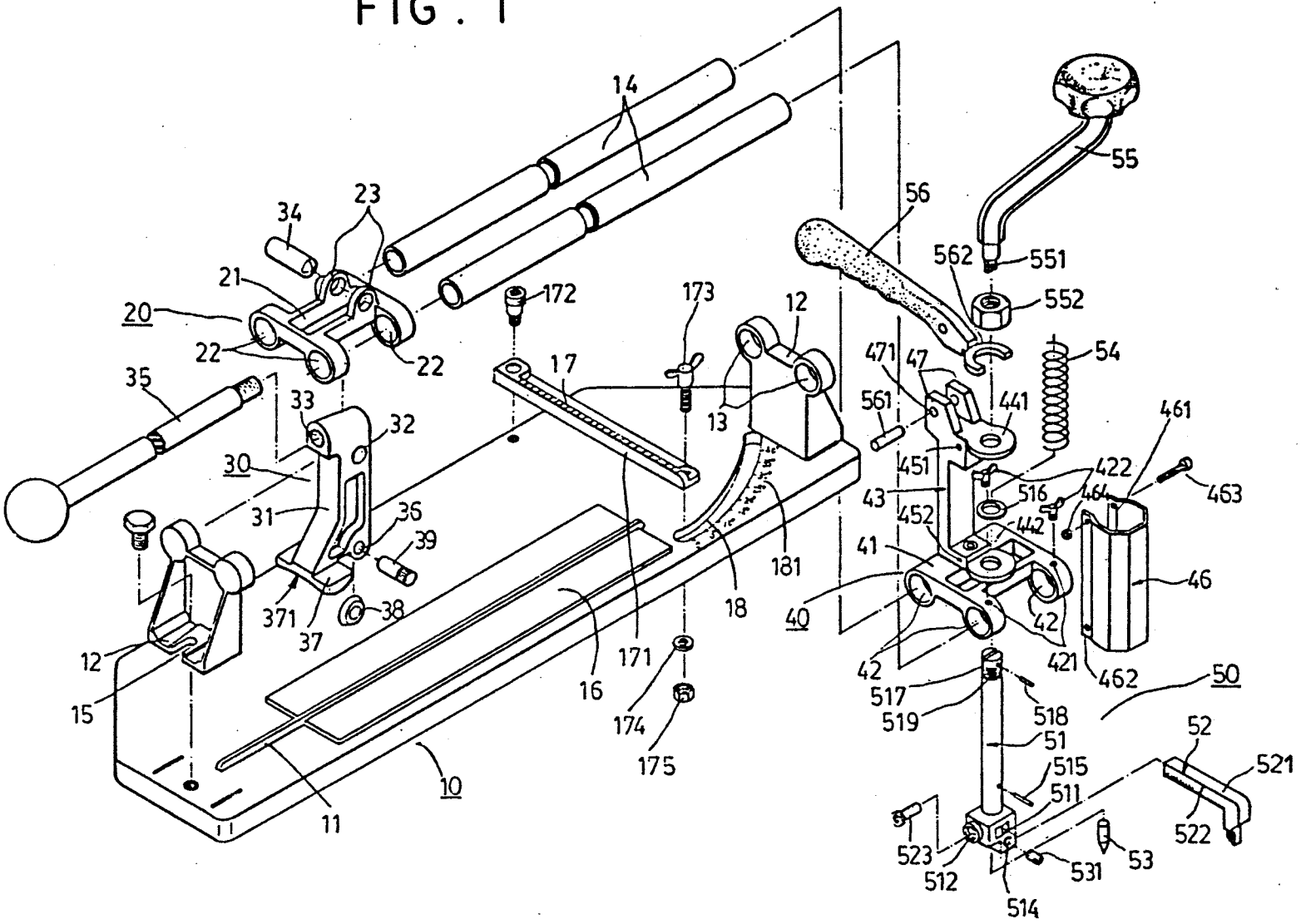
FIG. 1 is an exploded view showing a preferred embodiment of a glazed tile cutter according to the present invention.
Figure 2:
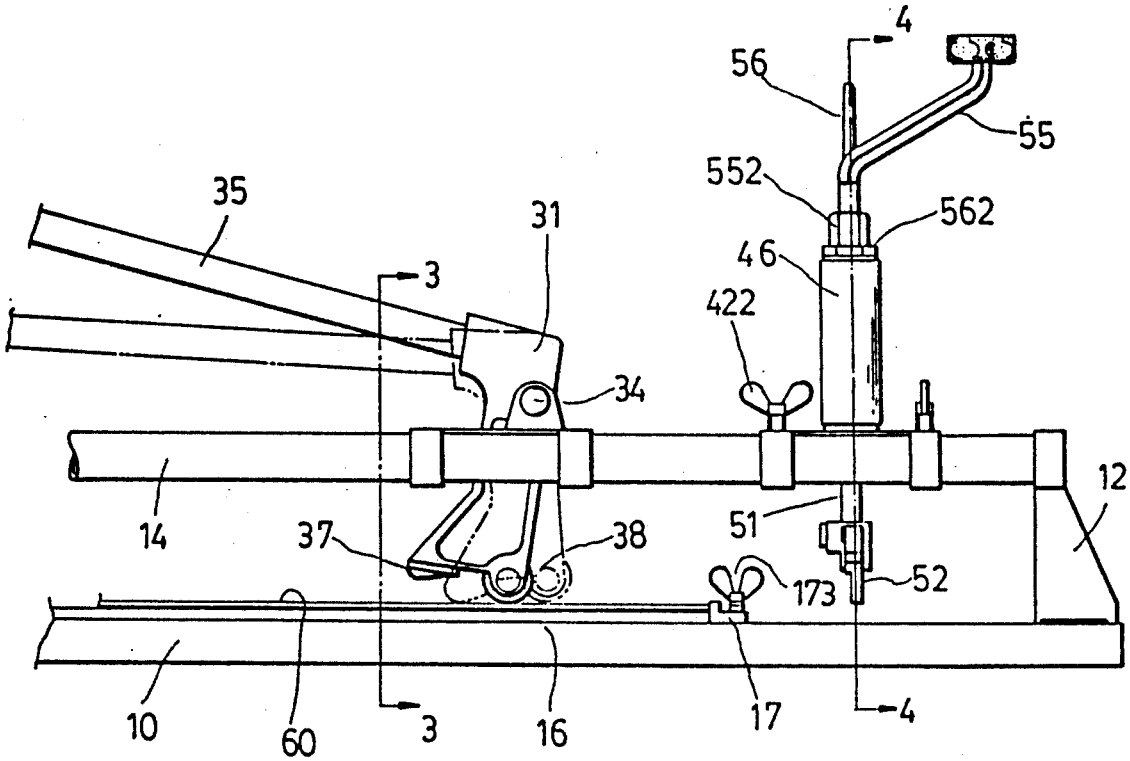
FIG. 2 is a front view showing a glazed tile cutter in FIG. 1.
Figure 3:
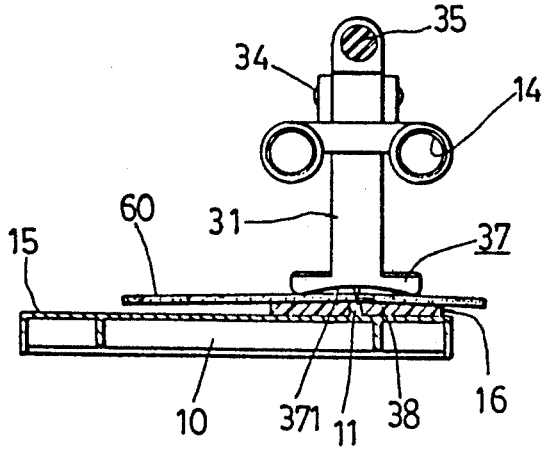
FIG. 3 is a sectional view taken along line 3—3 in FIG. 2.
Figure 4:
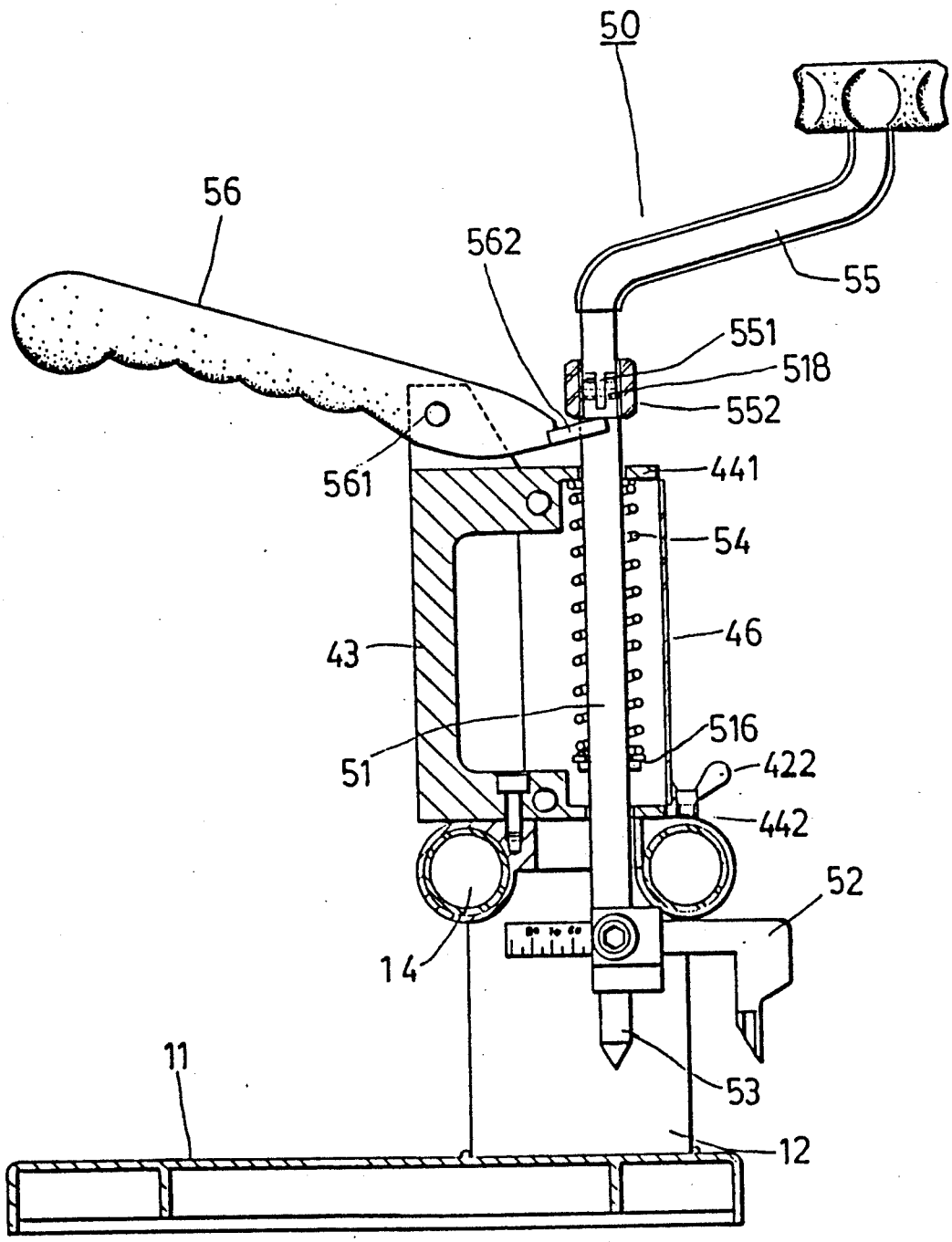
FIG. 4 is a sectional view taken along line 4—4 in FIG. 2.

Referring now to FIGS. 1-4, a glazed tile cutter according to the present invention includes an elongate base 10, respectively mounted on two longitudinal ends thereof are two brackets 12 parallelly longitudinally mounting therebetween are two sliding rods 14, slidably mounted thereon are two sliding pieces 20,40, respectively fixed thereto two cutters 30,50 respectively for straightly and circularly cutting a glazed tile, and a stopper 17 mounted on base 10 which has longitudinally attached thereon an elongate pad piece 16.

Each bracket 12 includes two spaced recessed tops 13 respectively receiving therein respective ends of sliding rods 14 forming a plane parallel to the surface 15 of base 10. Stopper 17 is slender and has a first end pivotably mounted on base 10 by screw 172, a stopping surface 171 for stopping against a side surface of a glazed tile to be cut and a holed second opposite end through which and an arcuate groove 18 on base 10 a positioner 173 can pass to cooperate with a nut 175 and a washer 174 to secure stopper 17 at any a desired pivoted position on base 10 having a scale 181 provided along arcuate groove 18. Sliding piece 20 includes a body 21, two pairs of side sleeves 22 respectively sleeving therein sliding rods 14 and two holed top lugs 23. Sliding piece 40 includes a body 41, two pairs of side sleeves 42 respectively sleeving therein sliding rods 14, and two winged screws 422 capable of respectively passing through screw holes 421 on sleeves 42 to fix or position sliding piece 40 on sliding rods 14 at a specific slid position.

Cutter 30 includes a bracket 31, a pin 39 passing into a pinhole 36 on bracket 31 and pinning a cutting wheel 38 to the bottom end thereof, a bottom pressing foot 37 having an arcuate bottom pressing surface 371, an actuating arm 35 screwed to a screw hole 33 of bracket 31, and a further pin 34 pinning through holed lugs 23 and a through hole 32 on bracket 31 in order that bracket 31 is pivotally connected to sliding piece 20. Cutter 50 includes a bracket 43 fixed on sliding piece 40 and having two holed tops 47 and two holed ends 441,442 vertically slidably receiving therein a shaft 51 pinning thereunder a centering pin 53 by a screw pin 531 pinning into a screw hole 514, an L-shaped cutter 52 having a scaled arm 522 and a cutting portion 521 and slidably mounted in a crossectionally rectangular hole 511 of shaft 51 to be held in a specific position by a bolt 523 screwedly passing through a screw hole 512 communicating with hole 511 to bolt against scaled arm 522 s that cutting portion 521 and shaft 51 can have therebetween an adjustable distance, a ring 516 sleeving on shaft 51 and stopped by a pin 515, a coil spring 54 sleeved on shaft 51 and mounted between ring 516 and holed end 441 for downwardly biassing shaft 51, a revolving arm 55 having a holed squared end 551 pivotally pinned by a pin 518 in a slot 517 provided in the top end of shaft 51, a nut 552 capable of being screwed on a threaded portion 519 of the top end of shaft 51 to confine therein the engaging portions of shaft 51 and revolving arm 55 to enable the latter to have a positive revolution and capable of being screwed off threaded portion 519 to allow revolving arm 55 to be downwardly pivoted about pin 518 by an angle of 90 degrees, and a handle 56 pinned between tops 47 having holes 471 by a pin 561 and having a forked front 562 mounted between holed end 441 and nut 552 so that when downwardly urged at the free end thereof, it can counteract the action of coil spring 54 in order to upwardly move shaft 51. A housing 46 having holes 461, 462 is attached to bracket 43 by nuts 464 bolts 463 screwed through holes 451, 452 on bracket 43.

Figure 5:
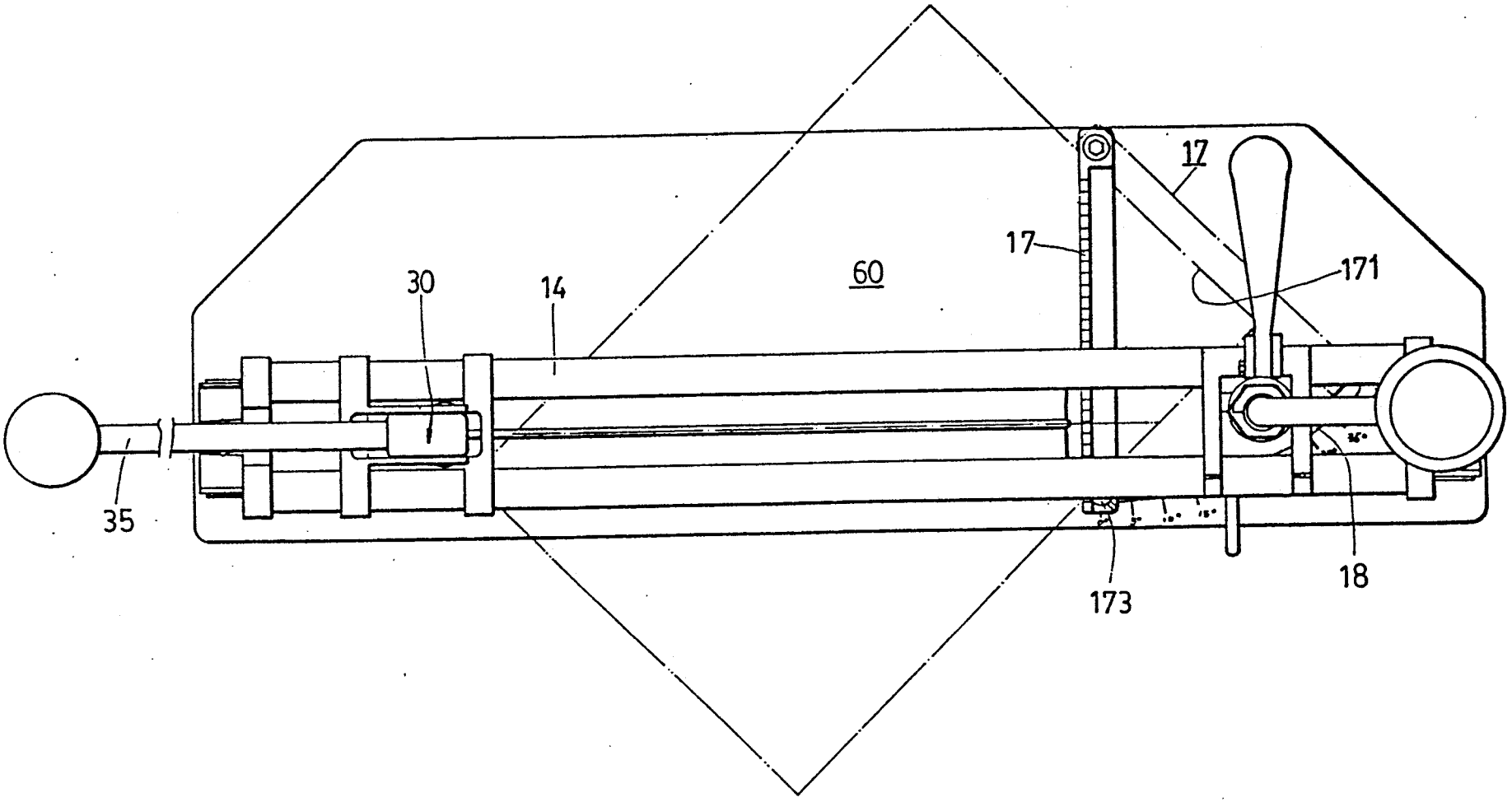
FIG. 5 is a top view showing a straight cutter of a glazed tile cutter in FIG. 1 in operation.

As shown in FIG. 5, when the present cutter is to inclinedly cut a glazed tile 60, nut 175 is first loosened and positioner 173 is brought to move along arcuate groove 18 to desiredly incline stopper 17 on base 10 and then nut 175 is re-tightened. The glazed tile 60 to be cut is placed on pad piece 16 and has a side surface matching against stopping surface 171. Then, cutting wheel 38 is caused to forcefully run over glazed tile 60 back and forth for several times to produce a notch on glazed tile 60. After actuating arm 35 is downwardly urged, pressing surface 371 will cooperate with bar projection 11 to cut glazed tile 60 into two halves along the notch. Certainly, stopper 17 can have its first mounting end pivotally mounted on base 10 adjacent to a side thereof opposite to that shown in FIG. 5.

Figure 6:
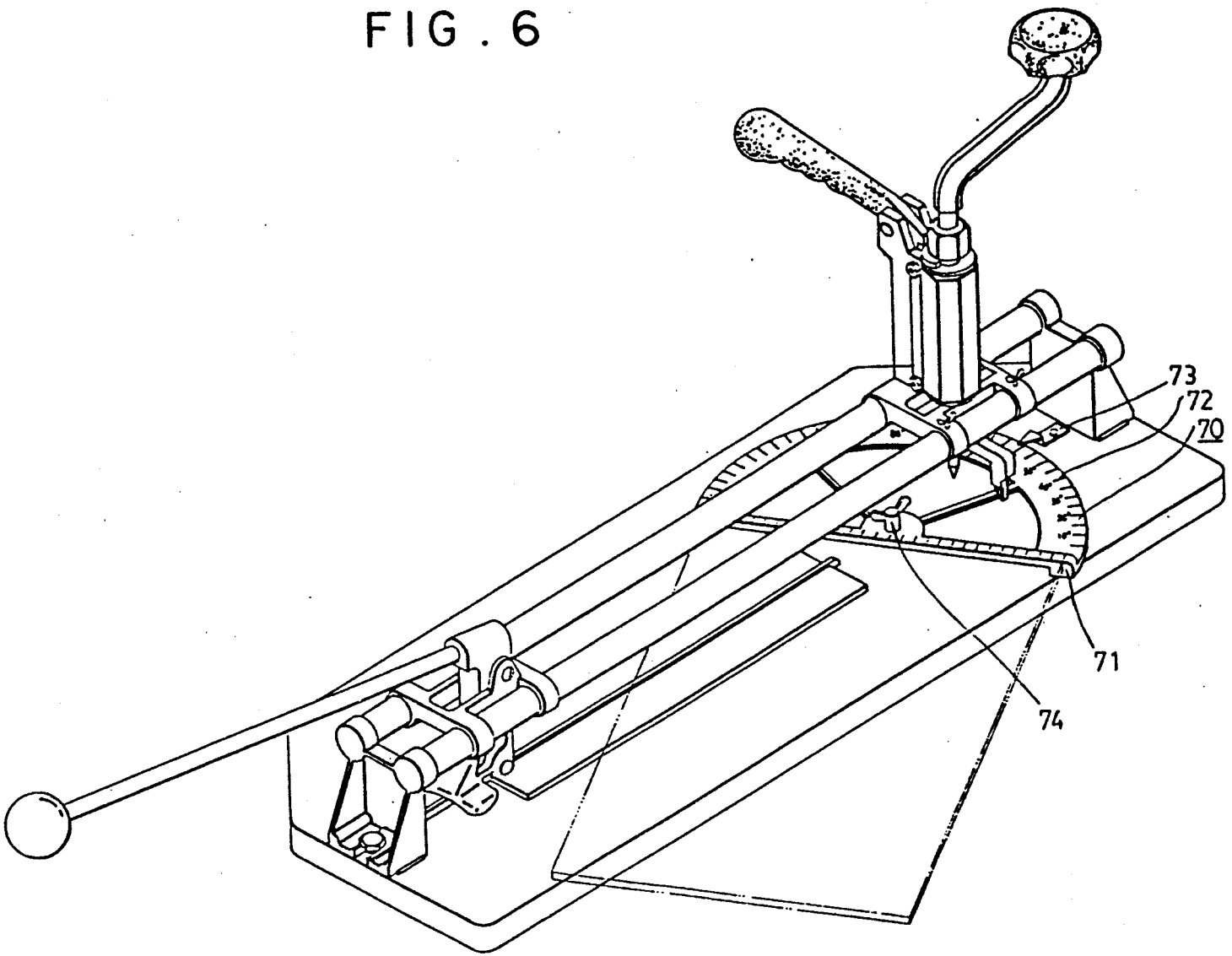
FIG. 6 is a perspective view showing a further preferred embodiment of a glazed tile cutter according to the present invention.

As shown in FIG. 6 the stopper can alternatively be a semi-circular piece 70 having a chord side 61 and an arcuate scaled side or rim 72 cooperating with an index 73 mounted on base 10 for indicating the inclining degree of stopper 70 with respect to base 10. The chord side includes a stopping surface 71 and an intermediate hole through which a pinning screw 74 can pass to cooperate with a nut for rotatably mounting stopper 70 on base 10. Before cutting, stopper 70 is properly inclined on base 10, if necessary, in order that the glazed tile 60 having a side surface matching against stopping surface 71 can be accurately cut by the present cutter.

If the present glazed tile cutter is to be used for circularly cutting glazed tile 60, cutter 30 is first slid to one respective end of base 10 and cutter 50 is slid to a position right above glazed tile 60 and fixed thereon by screws 422. After downwardly urging the free end of handle 56 to upwardly move shaft 51, centering pin 53 and cutter 52, the foreign force applying on handle 56 is released to allow coil spring 54 to enable centering pin 53 and cutting portion 521 of cutter 52 to urge against glazed tile 60. Then, by forcefully revolving revolving arm 55 again and again, cutting portion 521 is in turn caused to revolve around centering pin 53 and to forcefully circularly run over glazed tile 60 to produce a circular notch thereon. Glazed tile 60 having thereon the notch can easily be circularly holed. Alternatively, the worker can continue revolving revolving arm 55 until the depth of the notch is equal to the thickness of glazed tile 60. As mentioned above, the diameter of the notch can easily be adjusted by adjusting the distance between cutting portion 521 and centering pin 53.

What I claim is:

1. A glazed tile cutter comprising:

an elongate base;

two spaced brackets respectively mounted on two longitudinal ends of said elongate base;

two sliding rods parallelly longitudinally mounted between said brackets;

a first sliding piece slidably mounted on said sliding rods;

a first cutter fixed to said first sliding piece for linearly cutting a tile placed on said elongate base;

a stopper pivotally mounted on said base and having a stopping surface capable of abutting one side edge of said tile;

a second sliding piece for circularly cutting said tile, said second cutter including:

a shaft vertically slidably mounted on said second sliding piece;

a centering pin mounted under said shaft;

an L-shaped cutter having a cutting portion and transversely slidably mounted in said shaft in a manner that said cutting portion and said shaft can have a distance therebetween adjustable and said cutting portion to revolve around said centering pin;

a coil spring for downwardly biassing said shaft;

a revolving arm fixed to a top end of said shaft; and a handle pivotally mounted on said second sliding piece and capable of counteracting an action of said coil spring in order to upwardly move shaft.

2. A glazed tile cutter according to claim 1 wherein said L-shaped cutter provides thereon a scale for indicating said distance.

3. A glazed tile cutter according to claim 6 wherein said stopper is a semi-circular piece and pivotally mounted on said base and has an arcuate rim scale, and said base provides thereon an index for cooperating with said rim scale to indicate an angle that said stopper is pivoted with respect to said base.

4. A glazed tile cutter according to claim 6 wherein said stopper has a first end pivotally mounted on said base and a second opposite end, said base has an arcuate groove, and said tile cutter has a positioner passing through said second opposite end and said arcuate groove to move along said arcuate groove and to thus position said stopper in a particular pivoted position.

5. A glazed tile cutter according to claim 4 wherein said base includes a scale provided along said arcuate groove for indicating an angle that said stopper is pivoted with respect to said base.

* * * * *